US008154459B2

(12) United States Patent
Teshima et al.

(10) Patent No.: US 8,154,459 B2
(45) Date of Patent: Apr. 10, 2012

(54) ANTENNA DEVICE HAVING MULTIPLE RESONANT FREQUENCIES AND RADIO APPARATUS

(75) Inventors: Masao Teshima, Tokyo (JP); Hiroshi Shimasaki, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 365 days.

(21) Appl. No.: 12/265,797

(22) Filed: Nov. 6, 2008

(65) Prior Publication Data

US 2009/0201210 A1 Aug. 13, 2009

(30) Foreign Application Priority Data

Feb. 12, 2008 (JP) ..... 2008-030961

(51) Int. Cl.
*H01Q 1/24* (2006.01)

(52) U.S. Cl. ..... 343/702; 343/700 MS

(58) Field of Classification Search ..... 343/702, 343/700 MS, 729, 737, 913
See application file for complete search history.

(56) References Cited

U.S. PATENT DOCUMENTS

| | | | | |
|---|---|---|---|---|
| 7,336,229 | B1 * | 2/2008 | Tseng et al. | 343/702 |
| 7,477,199 | B2 * | 1/2009 | Hotta et al. | 343/702 |
| 2002/0126047 | A1 * | 9/2002 | Laureanti | 343/700 MS |
| 2007/0030198 | A1 * | 2/2007 | Wei | 343/700 MS |

FOREIGN PATENT DOCUMENTS

| | | | |
|---|---|---|---|
| JP | 2004-172912 | A | 6/2004 |
| JP | 2005-94501 | A | 4/2005 |
| JP | 2005-191718 | A | 7/2005 |
| JP | 2006-246070 | A | 9/2006 |
| JP | 2007-202085 | A | 8/2007 |

OTHER PUBLICATIONS

Japanese Office Action dated Dec. 13, 2011 (and English translation thereof) in counterpart Japanese Application No. 2008-030961.

* cited by examiner

*Primary Examiner* — Jacob Y Choi
*Assistant Examiner* — Shawn Buchanan
(74) *Attorney, Agent, or Firm* — Holtz, Holtz, Goodman & Chick, PC

(57) ABSTRACT

An antenna device included in a radio apparatus having a printed board includes a ground conductor provided in the printed board, a first sub-element, a second sub-element and a short circuit element. The first sub-element is formed as an area having a first side and a second side crossing each other. The first side faces a side of the ground conductor. The first sub-element has a feed portion around a crossing of the first side and the second side. The second sub-element is formed to branch off from the first sub-element around an end of the second side being farther from the crossing, to be open-ended and to be directed at least partially in a direction opposite a direction from the crossing to an end of the first side opposite the crossing. The short circuit element short-circuits one of the first sub-element and the second sub-element with the ground conductor.

9 Claims, 10 Drawing Sheets

ANTENNA DEVICE HAVING MULTIPLE RESONANT FREQUENCIES AND RADIO APPARATUS

CROSS REFERENCE TO RELATED APPLICATIONS

This application is based upon and claims the benefit of priority from the prior Japanese Patent Application No. 2008-30961 filed on Feb. 12, 2008; the entire contents of which are incorporated herein by reference.

BACKGROUND OF THE INVENTION

1. Field of the Invention

The present invention relates to an antenna device and a radio apparatus, and in particular to an antenna device having multiple resonant frequencies and a radio apparatus equipped with the antenna device.

2. Description of the Related Art

There is a trend that mobile phones or personal computers (PCs) with radio capability have multiple purposes and multiple functions. The above trend requires an antenna device configured to work in multiple frequency bands or in a broad frequency range.

In order to meet such a requirement, antenna devices having multiple resonant frequencies or a broad frequency range are disclosed in Japanese Patent Publication of Unexamined Applications (Kokai), No. 2007-202085 or No. 2005-191718.

The broadband antenna of a built-in type disclosed in JP 2007-202085 is formed by a narrow strip shaped antenna element having an arc shaped portion facing a ground conductor and a projection on a back of the arc for adjusting impedance. An end of the narrow strip shaped antenna element is connected to the ground conductor.

The antenna disclosed in JP 2005-191718 is formed by triple layered and fan shaped conductive patterns having a portion corresponding to a pivot of the fan and facing a nearby ground conductor. According to a disclosed example, the antenna have resonant frequencies in a 3.7 gigahertz (GHz) band and a 6.2 GHz band, and may extend a frequency characteristic up to a higher frequency band.

The broadband antenna disclosed in JP 2007-202085 includes the element having a core portion having an end being short-circuited with a ground plate. The antenna has the arc shaped portion on a side of the element facing the ground plate, and has the projection for adjusting the impedance on the back side. As shown in FIG. 2 of JP 2007-202085, consequently, the antenna may possibly have a problem that a size of the antenna in a direction perpendicular to a side of the ground plate is likely to increase. Such a problem is obvious, e.g., in a note type personal computer (note PC), e.g., having a broadband antenna just above a display.

The antenna disclosed in JP 2005-191718 is formed in such a way that an arc of the fan sticks out in a direction perpendicular to a side of the ground conductor of a dielectric substrate. The antenna may possibly have a problem that a size of the antenna in a direction perpendicular to the side of the ground conductor is likely to increase. Such a problem is obvious, e.g., in a note PC having a broadband antenna just above a display. The antenna may possibly have another problem that the antenna needs to be somewhat thick due to the triple-layered structure, and thus the layers may possibly need to be aligned with one another.

If forcibly given insufficient size in the direction perpendicular to the side of the ground conductor, the above antennas may possibly suffer from a mismatch caused by decrease in impedance as observed at feed portions.

SUMMARY OF THE INVENTION

Accordingly, an object of the present invention is to provide an antenna device having multiple resonant frequencies, a broad frequency range and a necessary impedance characteristic simultaneously.

To achieve the above advantage, according to one aspect of the present invention, an antenna device included in a radio apparatus having a printed board includes a ground conductor provided in the printed board, a first sub-element, a second sub-element and a short circuit element. The first sub-element is formed as an area having a first side and a second side crossing each other. The first side faces a side of the ground conductor. The first sub-element has a feed portion around a crossing of the first side and the second side. The second sub-element is formed to branch off from the first sub-element around an end of the second side being farther from the crossing, to be open-ended and to be directed at least partially in a direction opposite a direction from the crossing to an end of the first side opposite the crossing. The short circuit element short-circuits one of the first sub-element and the second sub-element with the ground conductor.

DETAILED DESCRIPTION OF THE INVENTION

Figure 1:
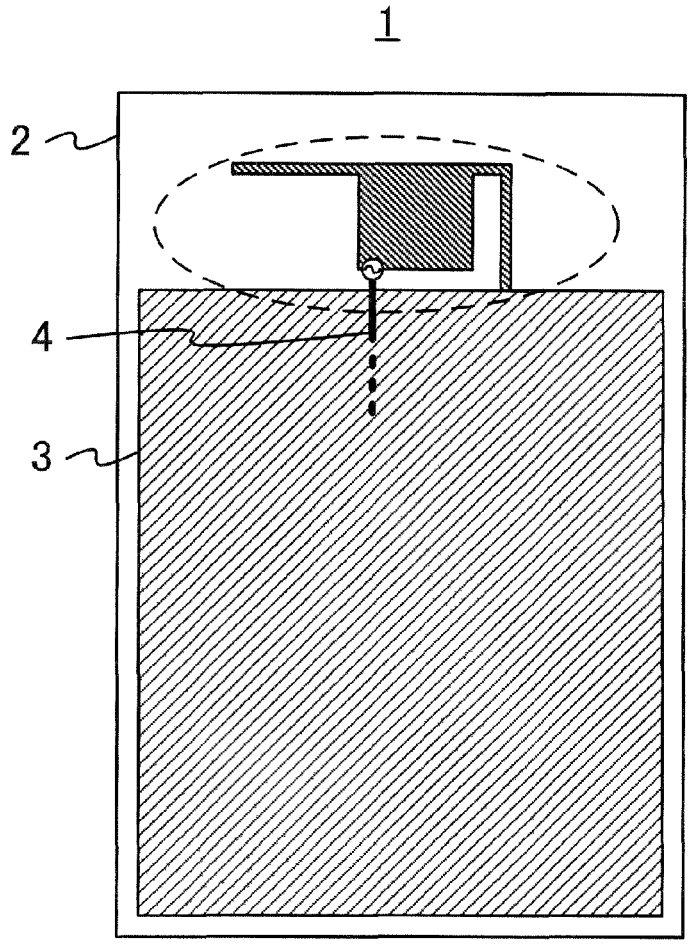
FIG. 1 is a plan view showing a configuration of an antenna device of a first embodiment of the present invention.

Hereinafter, embodiments of the present invention will be described in detail. In following descriptions, terms like upper, lower, left, right, horizontal or vertical used while referring to a drawing shall be interpreted on a page of the drawing unless otherwise noted. Besides, a same reference numeral given in no less than two drawings shall represent a same member or a same portion.

A first embodiment of the present invention will be described with reference to FIGS. 1-10. FIG. 1 is a plan view showing a configuration of an antenna device 1 of the first embodiment. The antenna device 1 is configured to work as a built-in antenna of a radio apparatus that is not shown. The radio apparatus has a printed board 2 shown in FIG. 1.

The antenna device 1 includes a ground conductor 3 of the printed board 2 and an antenna element arranged close to the ground conductor 3. The antenna element is formed by a plurality of sub-elements that will be explained later. The antenna element is connected to a radio circuit that is not shown through a feed line 4 arranged on a side of the ground conductor 3.

The antenna element included in the antenna device 1 is formed by a conductive pattern of the printed board 2 as shown surrounded by a dashed ellipse in FIG. 1. The antenna element is not limited to the conductive pattern of the printed board 2 as long as being arranged close to the ground conductor 3. Although being, e.g., a coaxial cable, the feed line 4 may be another kind of cabling material or a coplanar line formed by a conductive pattern of the printed board 2.

Figure 2:
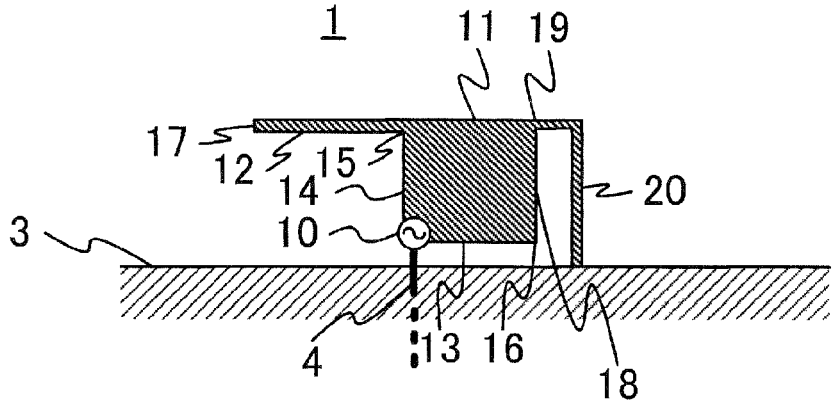
FIG. 2 is a plan view showing a configuration and shapes of main portions of the antenna device of the first embodiment.

With reference to FIG. 2, then, main portions of the antenna device 1 will be explained in detail. FIG. 2 is a plan view showing a configuration and shapes of main portions of the antenna device 1. The antenna element included in the antenna device 1 as described above has a first sub-element 11, a second sub-element 12 and a short circuit element 20. The first sub-element 11 includes a feed portion 10 connected to the feed line 4. The second sub-element 12 branches off from the first sub-element 11.

The first sub-element 11 is formed as an area surrounded by a fringe including a lower side 13 and a left side 14 crossing each other. The lower side 13 faces an upper side of the ground conductor 3. The left side 14 is in a direction crossing the upper side of the ground conductor 3. The feed portion 10 is located around a crossing of the lower side 13 and the left side 14, and in other words, around a left end (i.e., closer to the left side 14) of the lower side 13 of the first sub-element 11.

The second sub-element 12 branches off from the first sub-element 11 at a branch portion 15, i.e., an upper end of the left side 14 being farther from the crossing of the lower side 13 and the left side 14, or from the feed portion 10. The second sub-element 12 is directed leftward from the branch portion 15, i.e., in a direction opposite a direction from the crossing of the lower side 13 and the left side 14 (or from the feed portion 10) to a right end 16 of the lower side 13. The second sub-element 12 is open-ended and has an open end 17.

The short circuit element 20 short-circuits the first sub-element 11 and the ground conductor 3 at a short circuit portion 19, i.e., an upper end of a right side 18 that is included in the fringe of the firstsub-element 11.

Figure 3:
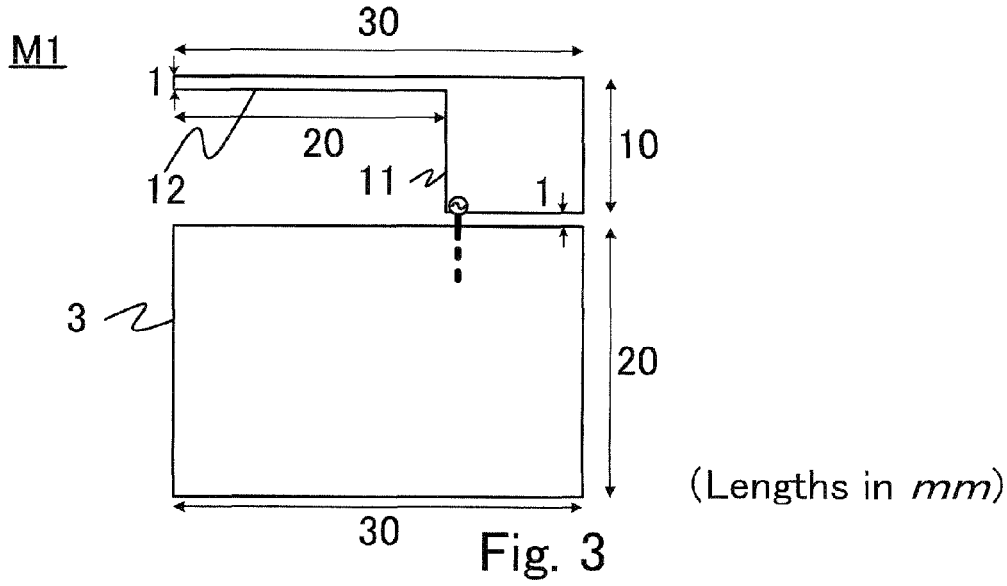
FIG. 3 is a plan view showing a shape and dimensions of a model having no short circuit element to be compared with the antenna device of the first embodiment.
Figure 4:
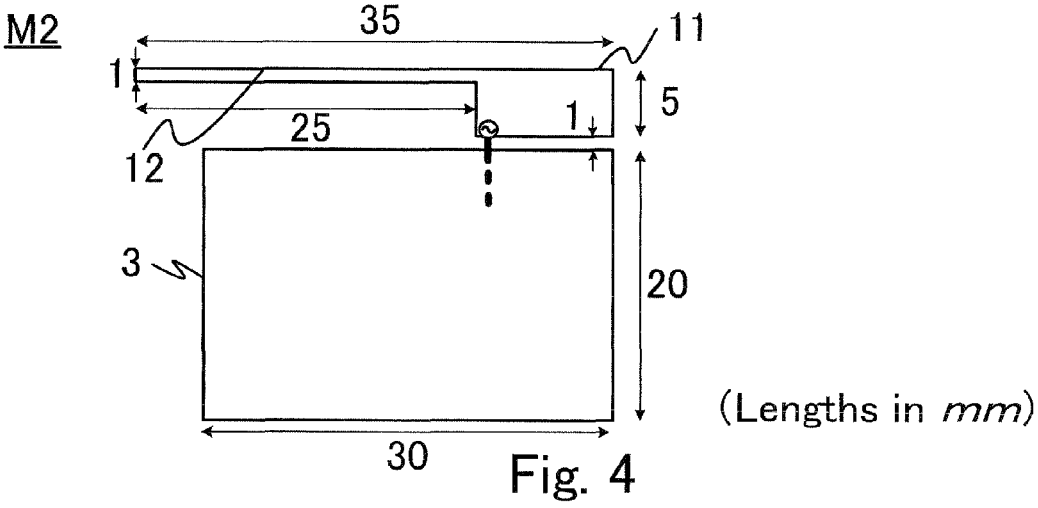
FIG. 4 is a plan view showing a shape and dimensions of another model having no short circuit element to be compared with the antenna device of the first embodiment.
Figure 5:
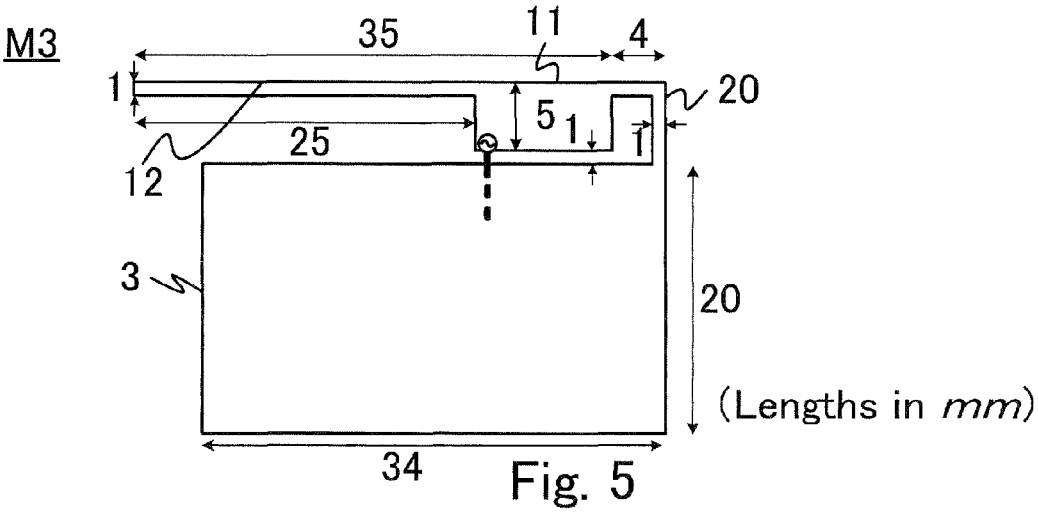
FIG. 5 is a plan view showing a shape and dimensions of a model exemplifying the antenna device of the first embodiment.

An impedance characteristic of the antenna device 1 estimated by a simulation in comparison with other antennas will be described with reference to FIGS. 3-10. FIGS. 3-4 are plan views showing shapes and dimensions of models configured not to have the short circuit element 20 of the antenna device 1 to be compared with the antenna device 1 (called the models M1 and M2). FIG. 5 is a plan view showing a shape and dimensions of a model M3 exemplifying the antenna device 1. Each of portions of the models M1 and M2 is given a same reference numeral as the corresponding one of the antenna device 1 shown in FIGS. 1-2 for convenience of explanation.

As shown in FIG. 3, the ground conductor 3 of the model M1 is 30 millimeters (mm) wide and 20 mm high. The first sub-element 11 is 10 mm wide and 10 mm high. The second sub-element 12 is 20 mm wide and 1 mm high (i.e., having a line width of 1 mm). The lower side 13 of the first sub-element 11 and the ground conductor 3 face each other at a distance of 1 mm.

As shown in FIG. 4, the ground conductor 3 of the model M2 is 30 mm wide and 20 mm high. The first sub-element 11 is 10 mm wide and 5 mm high. The second sub-element 12 is 25 mm wide and 1 mm high (i.e., having a line width of 1 mm). The lower side 13 of the first sub-element 11 and the ground conductor 3 face each other at a distance of 1 mm.

As shown in FIG. 5, the ground conductor 3 of the model M3 is 34 mm wide and 20 mm high. The first sub-element 11 is 10 mm wide and 5 mm high. The second sub-element is 25 mm wide and 1 mm high (i.e., having a line width of 1 mm). The lower side 13 of the first sub-element 11 and the upper side of the ground conductor 3 face each other at a distance of 1 mm.

As shown in FIG. 5, the short circuit element 20 is an inverted L shaped line, being 4 mm long rightward from the upper end of the right side 18 of the first sub-element 11 (i.e., the branch portion 19) and then 6 mm long downward. The short circuit element 20 short-circuits the branch portion 19 with the ground conductor 3. The short circuit element 20 has a line width of 1 mm.

Figure 6:
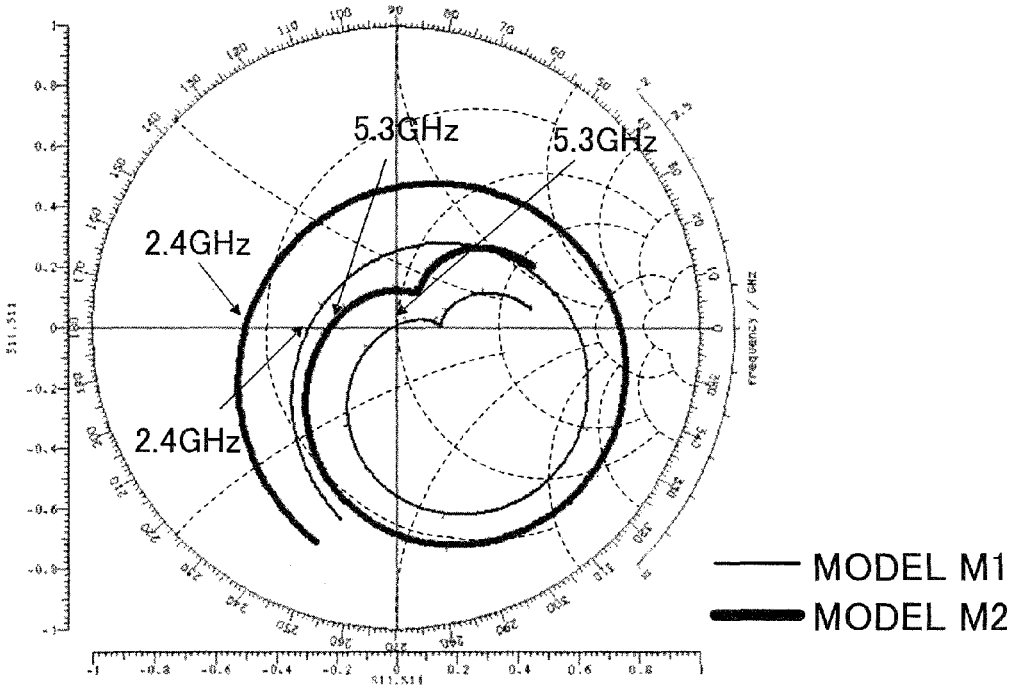
FIG. 6 is a Smith chart showing impedance characteristics in a 2-8 gigahertz (GHz) frequency range of the models shown in FIGS. 2-3.
Figure 7:
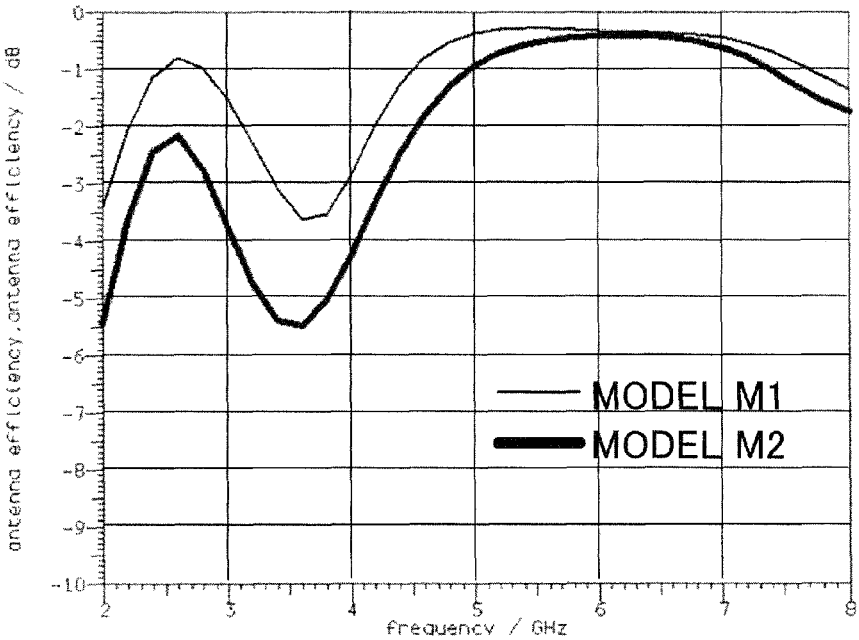
FIG. 7 is a graph showing radiation efficiency in the 2-8 GHz frequency range of the models shown in FIGS. 2-3.

FIG. 6 is a Smith chart showing impedance characteristics in a 2-8 gigahertz (GHz) frequency range of the models M1 and M2. FIG. 7 is a graph showing radiation efficiency characteristics in the 2-8 GHz frequency range of the models M1 and M2. FIG. 7 has a horizontal axis and a vertical axis representing frequencies (in GHz) and the radiation efficiency (in decibel (dB)), respectively. In FIG. 6, and also in FIG. 7, a fine solid curve and a bold solid curve represent the characteristics of the models M1 (the first sub-element 11 is 10 mm high) and M2 (the first sub-element 11 is 5 mm high), respectively.

As shown in FIGS. 6-7, the model M1 has resonant frequencies around 2.4 GHz (hereafter maybe called the lower range for convenience of explanation) and around 5.3 GHz (hereafter maybe called the higher range for convenience of explanation). Resonance in the lower range is determined by a length of a current distribution path from the feed portion 10, through the branch portion 15, to the open end 17 of the second sub-element 12. Resonance in the higher range is determined by a length of a current distribution path from the feed portion 10, through the right end 16 of the lower side 13 of the first sub-element 11, to the upper end of the right side 18.

The characteristics of the models M1 and M2 are compared with each other as follows. The model M2 in which the sub-element 11 is less high shows lower impedance than the model M1 as shown in FIG. 6, and consequently causes a greater mismatch and lower radiation efficiency as shown in FIG. 7. Why the model M2 shows the lower impedance is that the above the current distribution path is closer to the ground conductor 3 than the corresponding path of the model M1, and thus a magnitude of a current flowing to the ground conductor 3 through a capacitive coupling is greater.

That is, in a case where, e.g., a broadband antenna is arranged just above a display of a note PC, the configuration of the antenna, e.g., of the models M1 or M2 such that neither the first sub-element 11 nor the second sub-element 12 is short-circuited with the ground conductor 3 such as the models M1 and M2 may cause relatively poor matching and thus degrade the radiation efficiency due to a small dimension of the antenna in a vertical direction.

Figure 8:
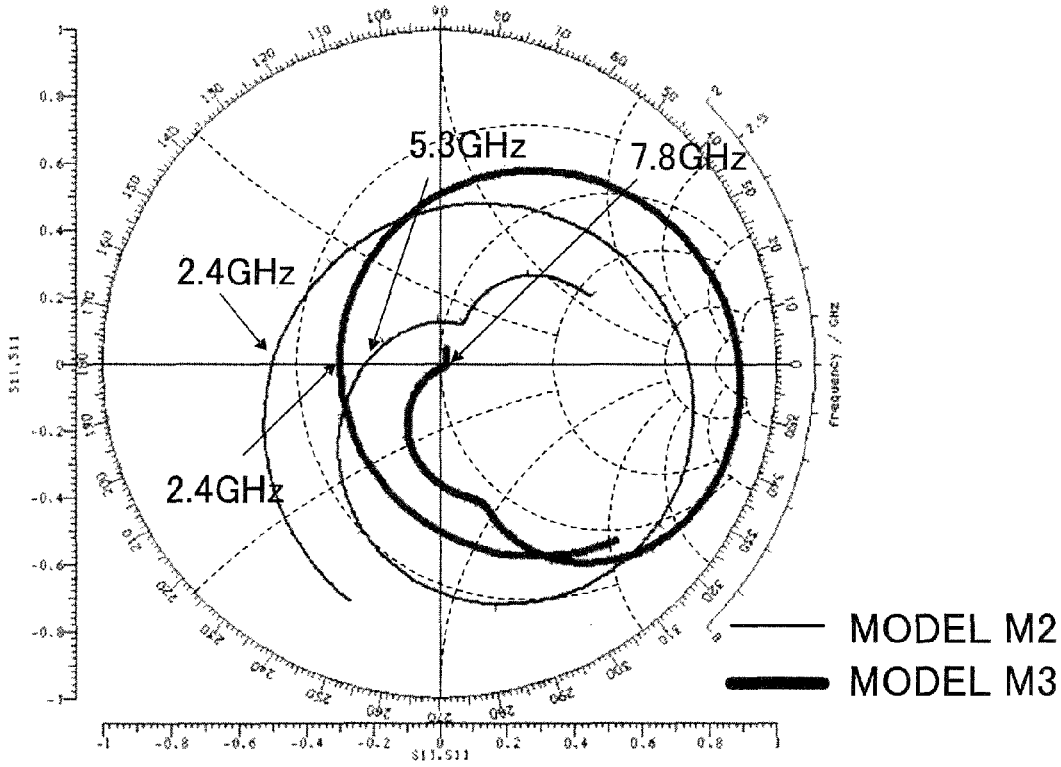
FIG. 8 is a Smith chart showing impedance characteristics in the 2-8 GHz frequency range of the models shown in FIGS. 3-4.
Figure 9:
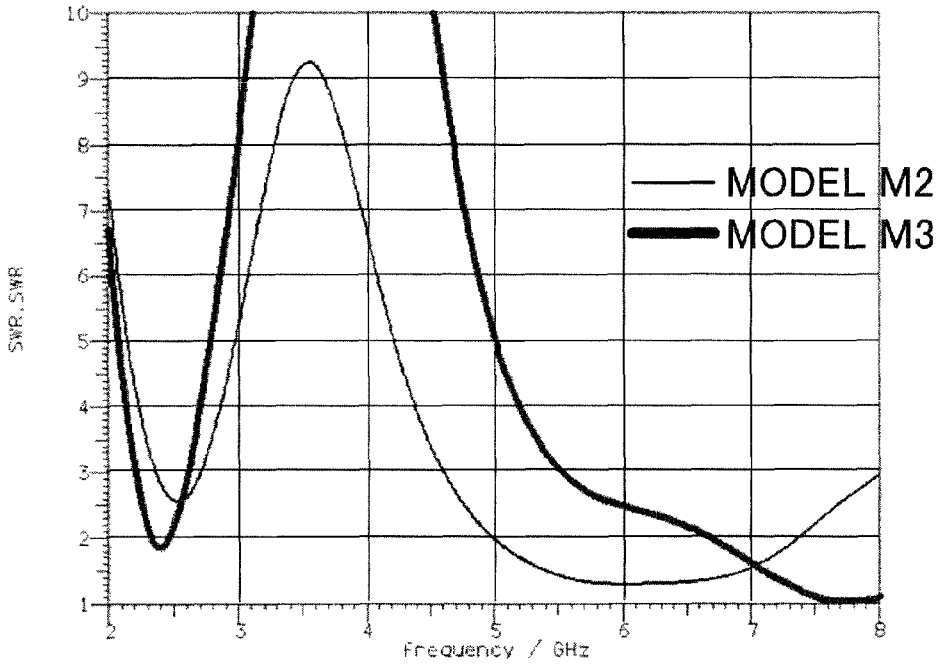
FIG. 9 is a graph showing voltage standing wave ratio (VSWR) characteristics in the 2-8 GHz frequency range observed at feed portions of the models shown in FIGS. 3-4.

FIG. 8 is a Smith chart showing impedance characteristics in the 2-8 GHz frequency range of the models M2 and M3. FIG. 9 is a graph showing voltage standing wave ratio (VSWR) characteristics in the 2-8 GHz frequency range observed at the feed portion 10 of the models M2 and M3. In FIG. 8, and also in FIG. 9, a fine solid curve and a bold solid curve represent the characteristics of the models M2 (having no short circuit element) and M3 (having the short circuit element 20), respectively.

The characteristics of the models M2 and M3 are compared with each other as follows. The model M3 having the short circuit element 20 shows higher impedance than the model M2 in the lower range as shown in FIG. 8, and consequently improves impedance matching with the feed line 4 and shows a lower VSWR characteristic than the model M2 as shown in FIG. 7. Why the model M3 shows the higher impedance in the lower range is that a current distribution path of the resonance in the lower range is also formed on the short circuit element 20, and thus a magnitude of the current flowing from the feed portion 10 decreases.

That is, in a case where, e.g., a broadband antenna is arranged just above a display of a note PC, the configuration of the antenna such that the first sub-element 11 is short-circuited with the ground conductor 3 such as the model M3 may have a better matching characteristic despite of the small dimension of the antenna in the vertical direction.

As shown in FIGS. 8-9 by the simulation data of the model M3 shown in FIG. 5, the antenna device 1 of the first embodiment may have better characteristics of impedance and matching in the lower range than the model M2 having no short circuit element. As shown in FIGS. 8-9, however, the model M3 has a resonant frequency around 7.8 GHz in the higher range that is higher than the resonant frequency of the model M2 around 5.3 GHz.

That might be because of a third harmonic excited on the current distribution path from the feed portion 10, through the branch portion 15, to the open end 17 of the second sub-element 12, or because of an equivalent loop antenna formed by the lower side 13 and the right side 18 of the first sub-element 11, the short circuit element 20 and a portion of the upper side of the ground conductor 3.

Figure 10:
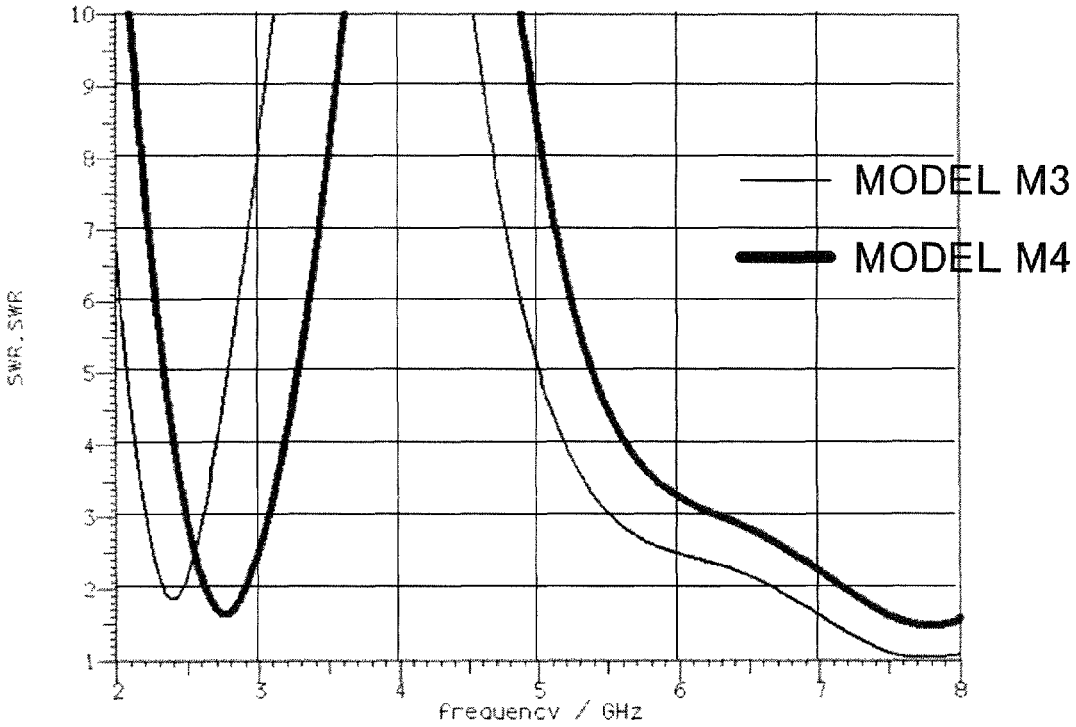
FIG. 10 is a graph showing VSWR characteristics in the 2-8 GHz frequency range observed at feed portions of the model shown in FIG. 4 and a modification of that model having a shorter second sub-element.

Possibility of the third harmonic is considered by estimating a VSWR-frequency characteristic of a model M4, i.e., a modification of the model M3 to be compared with the model M3. The second sub-element 12 of the model M4 is 20 mm long. FIG. 10 is a graph showing VSWR characteristics in the 2-8 GHz frequency range of the models M3 and M4. Horizontal and vertical axes of FIG. 10 are same as the horizontal and vertical axes of FIG. 9, respectively. In FIG. 10, a fine solid curve and a bold solid curve represent the characteristics of the models M3 (the second sub-element is 25 mm long) and M4 (the second sub-element is 20 mm long), respectively.

In the lower range shown in FIG. 10, as having a smaller length of the second sub-element 12, the model M4 has a higher resonant frequency than the model M3. In the higher range, however, as a similar difference between the models M3 and M4 may not be observed, the possibility of the third harmonic excited on the current distribution path including the second sub-element 12 is denied.

A reason why the model M3 has a higher resonant frequency than the model M2 in the higher range will be described below. A path is formed from the signal side of the feed portion 10, through the lower side 13 of the first sub-element 11, the right end 16 of the lower side 13, the right side 18, the branch portion 19 at the upper end of the right side 18, the short circuit element 20, and a portion of the ground conductor 3 to the ground side of the feed portion 10. The above path may form a kind of loop antenna, and a length of the path may correspond to a wavelength of a resonant frequency of the loop antenna.

The above problem may be solved so that improvement of the impedance characteristic in the lower range does not affect the resonant frequency in the higher range, as described later with respect to the second embodiment.

According to the first embodiment of the present invention described above, a broadband antenna configured to have a current distribution path arranged close to a ground conductor may improve a matching characteristic in some frequency range.

A second embodiment of the present invention will be described with reference to FIGS. 11-21. The second embodiment implements an antenna device 5 including a modification of the antenna element of the antenna device 1 of the first embodiment as shown surrounded by a dashed ellipse in FIG. 1. Accordingly, the portions such as the printed board 2, the ground conductor 3 and the feed line 4 will be used in a following description of the second embodiment, given the same reference numerals.

Figure 11:
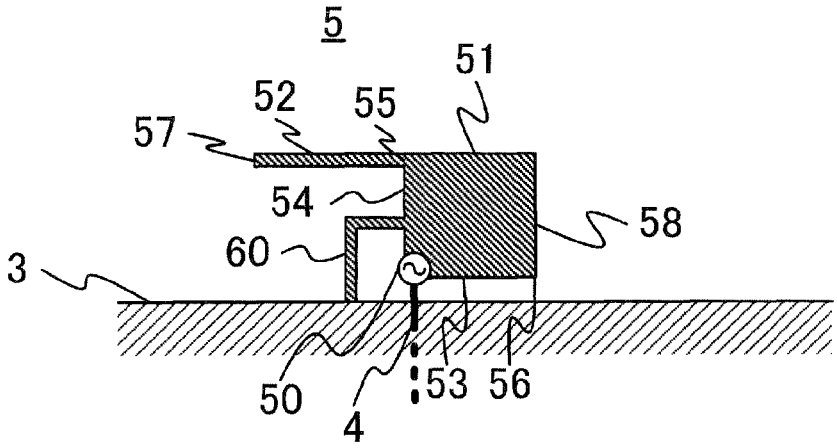
FIG. 11 is a plan view showing a configuration and shapes of main portions of an antenna device of a second embodiment of the present invention.

FIG. 11 is a plan view showing a configuration and shapes of main portions of the antenna device 5. The antenna element included in the antenna device 5 has a first sub-element 51, a second sub-element 52 and a short circuit element 60. The first sub-element 51 includes a feed portion 50 connected to the feed line 4. The second sub-element 52 branches off from the first sub-element 51.

The first sub-element 51 is formed as an area surrounded by a fringe including a lower side 53 and a left side 54 crossing each other. The lower side 53 faces the upper side of the ground conductor 3. The left side 54 is in a direction crossing the upper side of the ground conductor 3. The feed portion 50 is located around a crossing of the lower side 53 and the left side 54, and in other words, around a left end (i.e., closer to the left side 54) of the lower side 53 of the first sub-element 51.

The second sub-element 52 branches off from the first sub-element 51 at a branch portion 55, i.e., an upper end of the left side 54 being farther from the crossing of the lower side 53 and the left side 54, or from the feed portion 50. The second sub-element 52 is directed leftward from the branch portion 55, i.e., in a direction opposite a direction from the crossing of the lower side 53 and the left side 54 (or from the feed portion 50) to a right end 56 of the lower side 53. The second sub-element 52 is open-ended and has an open end 57.

Figure 12:
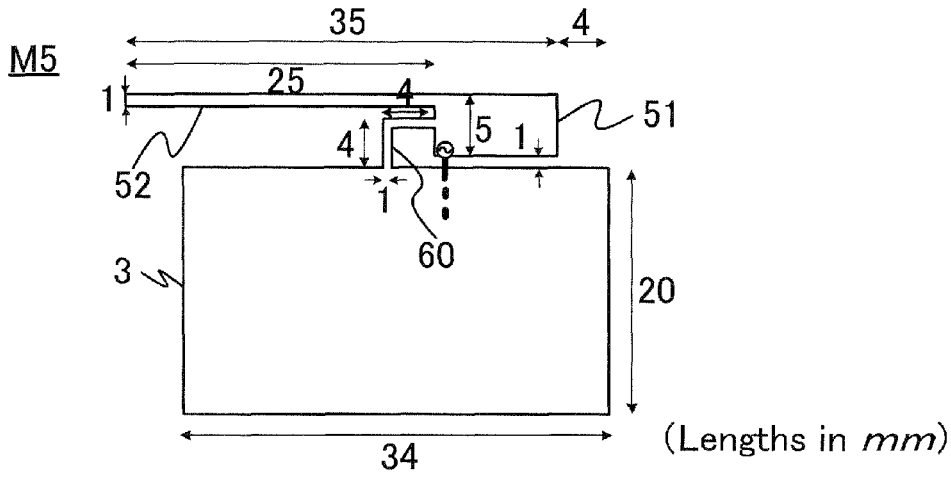
FIG. 12 is a plan view showing a shape and dimensions of a model exemplifying the antenna device of the second embodiment.

The short circuit element 60 short-circuits the first sub-element 51 and the ground conductor 3 at a portion of the left side 54 included in the fringe of the first sub-element 51. FIG. 12 is a plan view showing a shape and dimensions of a model M5 exemplifying the antenna device 5 so that an impedance characteristic of the antenna device 5 is estimated by a simulation.

As shown in FIG. 12, the ground conductor 3 of the model M5 is 34 mm wide and 20 mm high. The first sub-element 51 is 10 mm wide and 5 mm high. The second sub-element 52 is 25 mm wide and 1 mm high (i.e., having a line width of 1 mm). The lower side 53 of the first sub-element 51 and the upper side of the ground conductor 3 face each other at a distance of 1 mm.

As shown in FIG. 12, the short circuit element 60 is a sideways L shaped line, being 4 mm long leftward from the portion of the left side 54 of the first sub-element 51 and then 4 mm long downward. The short circuit element 60 short-circuits the portion of the left side 54 with the ground conductor 3. The short circuit element 60 has a line width of 1 mm. The model M5 may be modified not to have the short circuit element 60 into a model M6 to be compared with the model M5.

Figure 13:
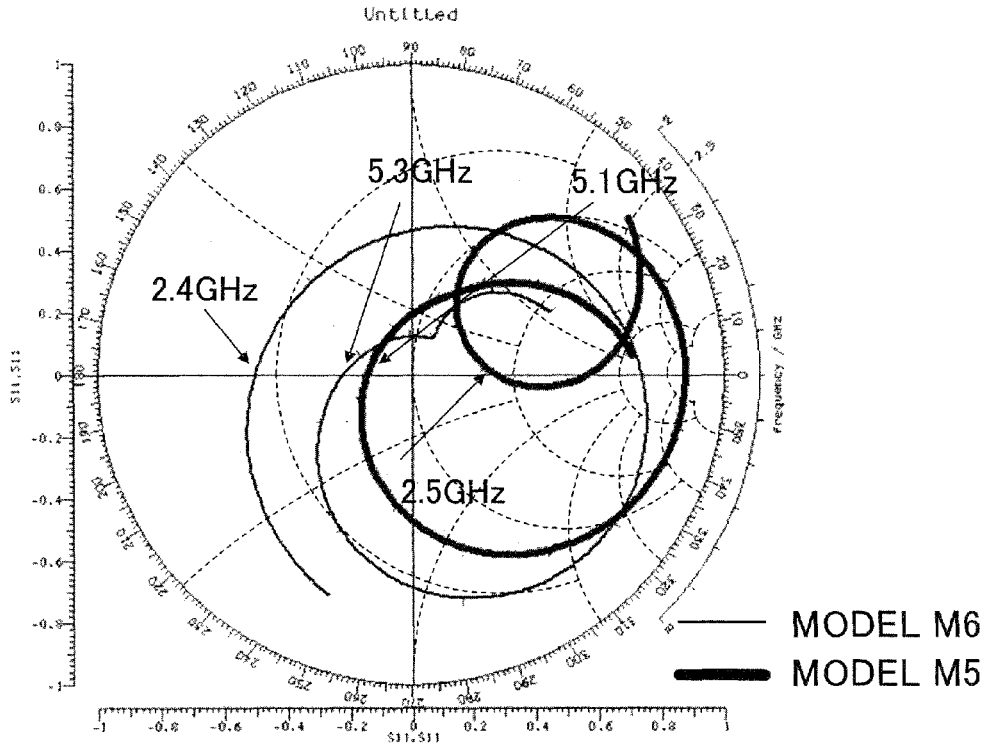
FIG. 13 is a Smith chart showing impedance characteristics in the 2-8 GHz frequency range of the model shown in FIG. 12 and a modification of that model having no short circuit element.
Figure 14:
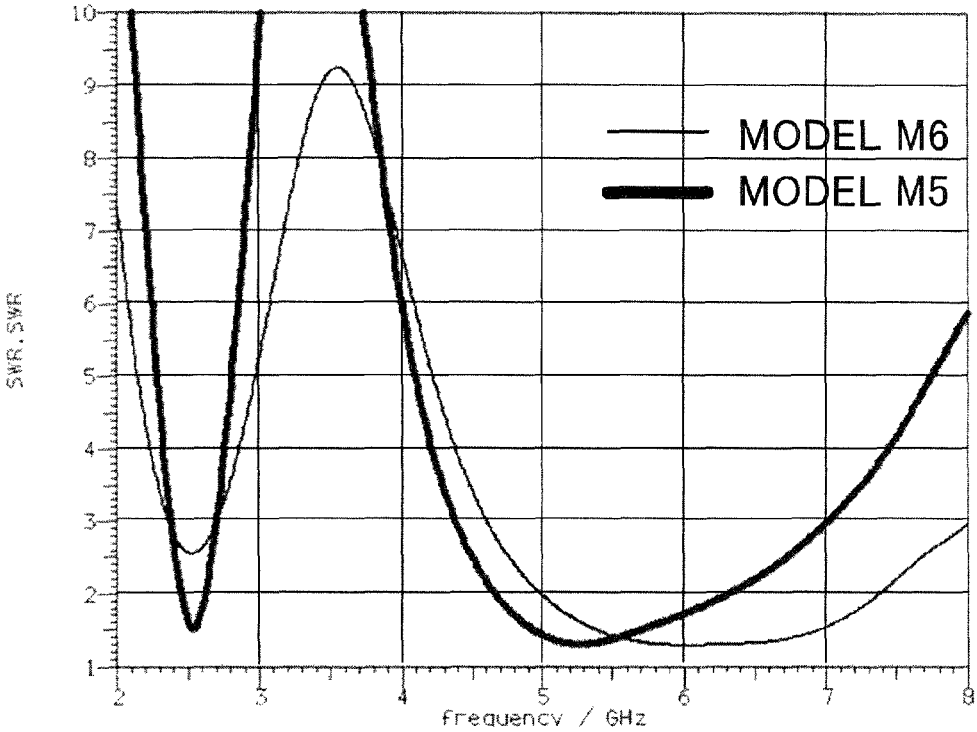
FIG. 14 is a graph showing VSWR characteristics in the 2-8 GHz frequency range observed at feed portions of the model shown in FIG. 12 and the modification of that model having no short circuit element.

FIG. 13 is a Smith chart showing impedance characteristics in the 2-8 GHz frequency range of the models M5 and M6. FIG. 14 is a graph showing VSWR characteristics in the 2-8 GHz frequency range observed at the feed portion 50 of the models M5 and M6. In FIG. 8, and also in FIG. 9, a fine solid curve and a bold solid curve represent the characteristics of the models M6 (having no short circuit element) and M5 (having the short circuit element 60), respectively.

The model M5 having the short circuit element 60 shows higher impedance than the model M6 in the lower range as shown in FIG. 13, and consequently improves impedance matching with the feed line 4 and shows a lower VSWR characteristic than the model M6 as shown in FIG. 14.

As shown in FIGS. 13-14, there is no much difference between the resonant frequencies of the models M5 and M6 in the higher range, although the resonant frequencies in the higher range of the first embodiment are different depending on with or without the short circuit element. That is because the antenna device 5 includes no equivalent loop antenna such as the loop antenna formed in the configuration of the first embodiment, and thus the resonant frequency in the higher range is determined by a length of a current distribution path including the lower side of the first sub-element 51.

Figure 15:
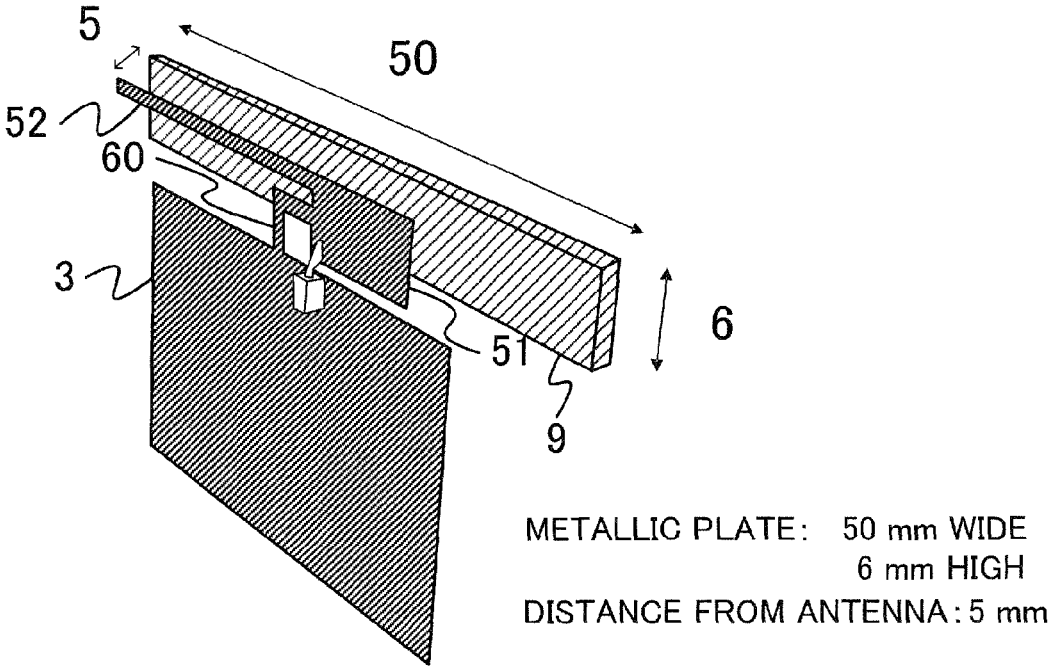
FIG. 15 is an explanatory diagram showing dimensions and a relative position of the antenna device of the second embodiment and a metallic plate arranged close to each other.

A characteristic of the antenna device 5 being arranged close to a metallic plate will be described with reference to FIGS. 15-17. Such an arrangement may be assumed in a case where an electronic device such as a personal computer or a mobile phone is equipped with the antenna device 5. If an antenna and a metallic plate are arranged close to each other, impedance observed at a feed portion of the antenna may decrease due to a current flowing on the metallic plate through a capacitive coupling between the antenna element and the metallic plate.

With respect to the above decrease in impedance, characteristics of the model M5 having the short circuit element 50 and the model M6 having no short circuit element will be compared by a simulation. As shown in FIG. 15, the simulation uses a model that includes a metallic plate 9 having dimensions of 50 mm×6 mm and being arranged at a distance of 5 mm from the model M5 or M6 of the antenna device 5.

Figure 16:
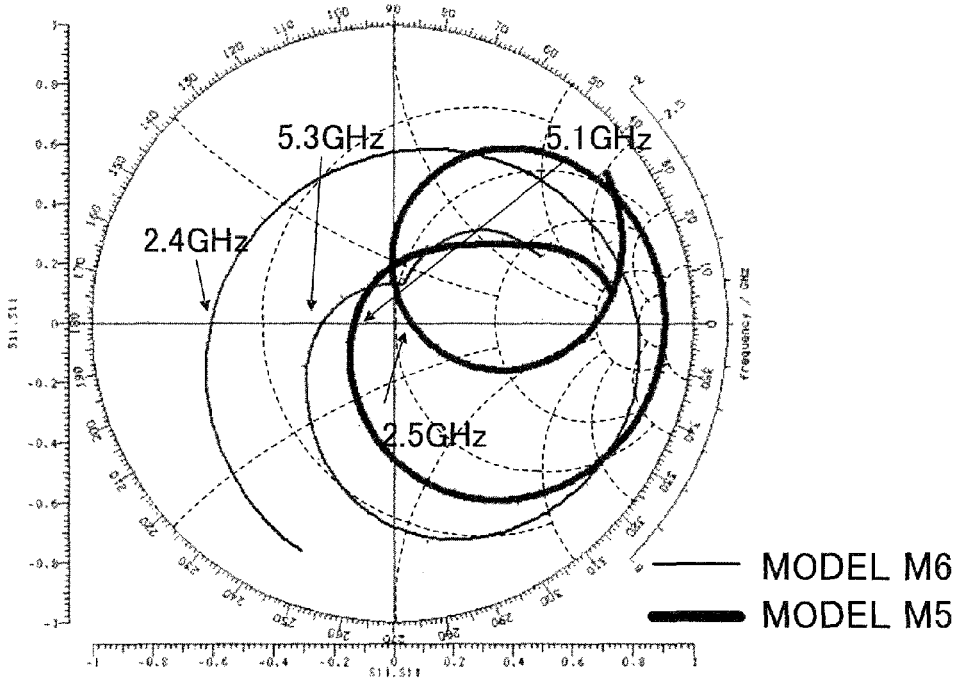
FIG. 16 is a Smith chart showing impedance characteristics in the 2-8 GHz frequency range of the model shown in FIG. 12 and the modification of that model having no short circuit element in the arrangement shown in FIG. 15.

FIG. 16 is a Smith chart showing impedance characteristics in the 2-8 GHz frequency range of the models M5 and M6 in the presence of the closely arranged metallic plate 9. FIG. 17 is a graph showing radiation efficiency characteristics in the 2-8 GHz frequency range of the models M5 and M6. In FIG. 16, and also in FIG. 17, a fine solid curve and a bold solid curve represent the characteristics of the models M6 (having no short circuit element) and M5 (having the short circuit element 60), respectively.

Figure 17:
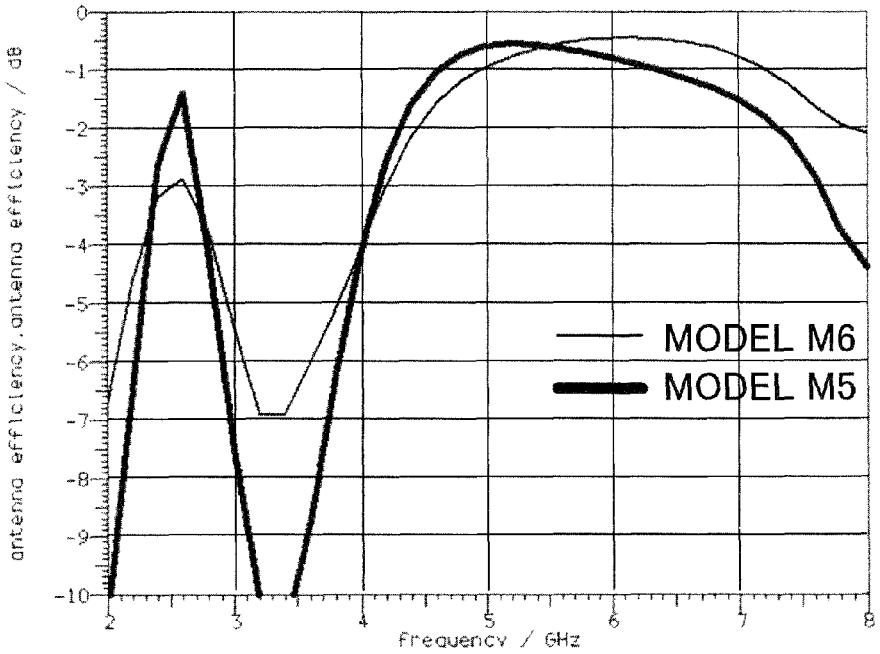
FIG. 17 is a graph showing radiation efficiency characteristics in the 2-8 GHz frequency range of the model shown in FIG. 12 and the modification of that model having no short circuit element in the arrangement shown in FIG. 15.

As shown in FIGS. 16-17, there is no much difference between the resonant frequencies of the models M5 and M6 in the lower and higher ranges, and the model M5 shows higher impedance and radiation efficiency than the model M6 at those resonant frequencies. That shows an obvious effect of having the short circuit element 60.

Figure 18:
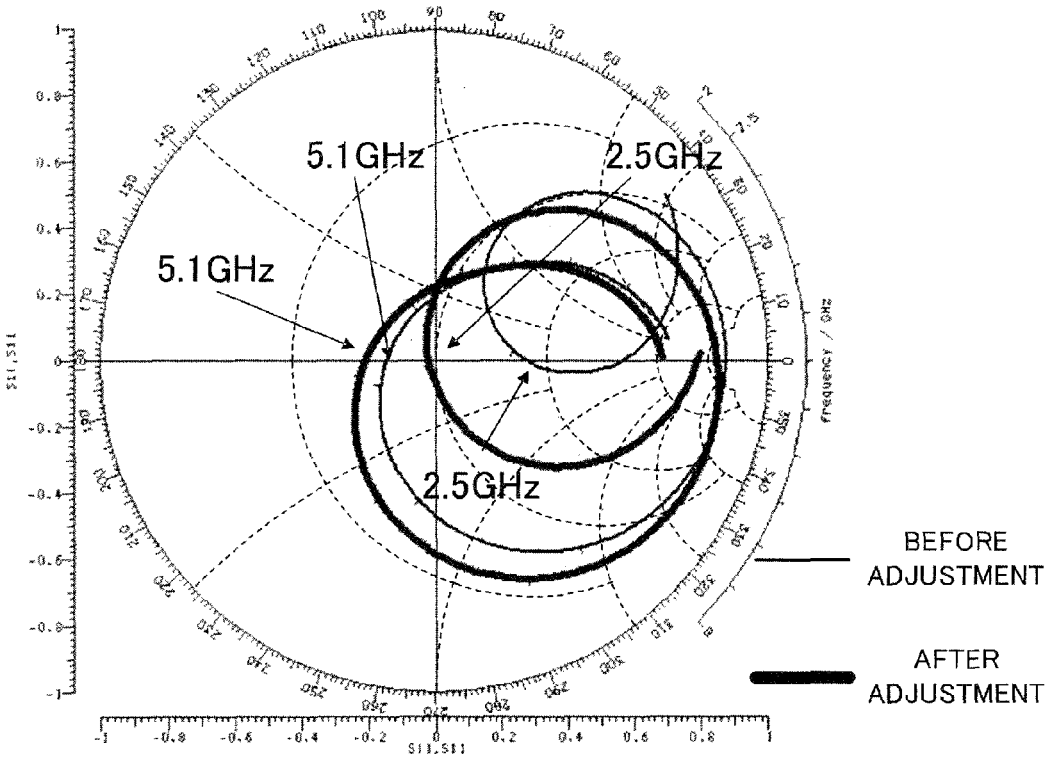
FIG. 18 is a Smith chart showing impedance characteristics in the 2-8 GHz frequency range of the model shown in FIG. 12 and the modification of that model having no short circuit element before and after adjustment of the short circuit element.
Figure 19:
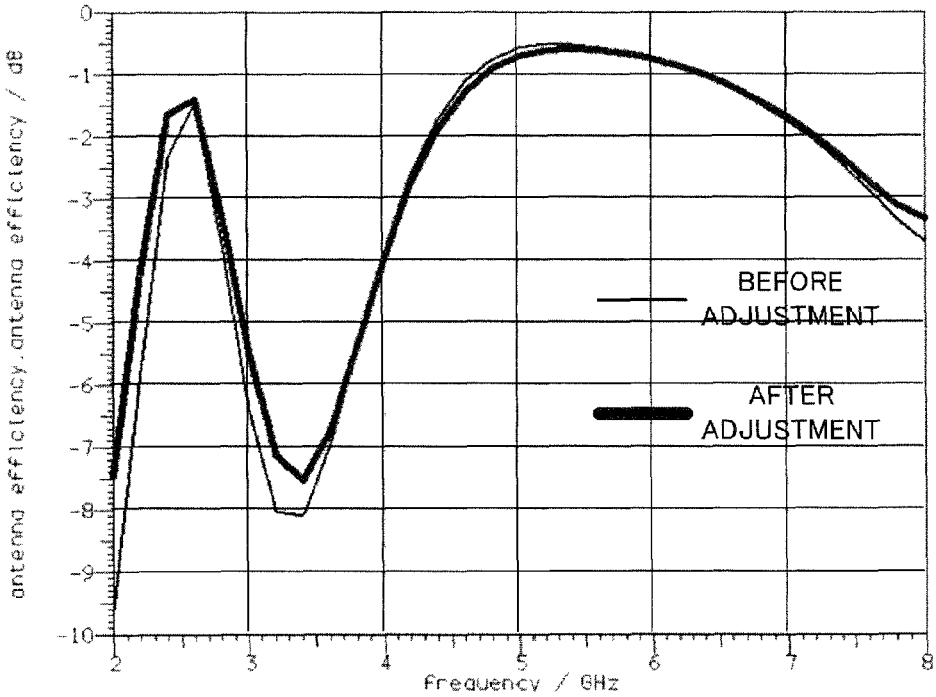
FIG. 19 is a graph showing VSWR characteristics in the 2-8 GHz frequency range observed at the feed portions of the model shown in FIG. 12 and the modification of that model having no short circuit element before and after the adjustment of the short circuit element.

The impedance of the antenna device 5 may be adjusted depending on the line width of the short circuit element 60, and depending on with which portion of the ground conductor 3 the short circuit element 60 is short-circuited. FIGS. 18-19 are a Smith chart and a graph of frequency characteristics of the radiation efficiency both representing impedance characteristics before and after such an adjustment. In FIG. 18, and also in FIG. 19, a fine solid curve and a bold solid curve represent the characteristics before and after the adjustment, respectively. As described above, the impedance characteristics may be finely adjusted by the adjustment of the shape of the short circuit element 60.

Figure 20:
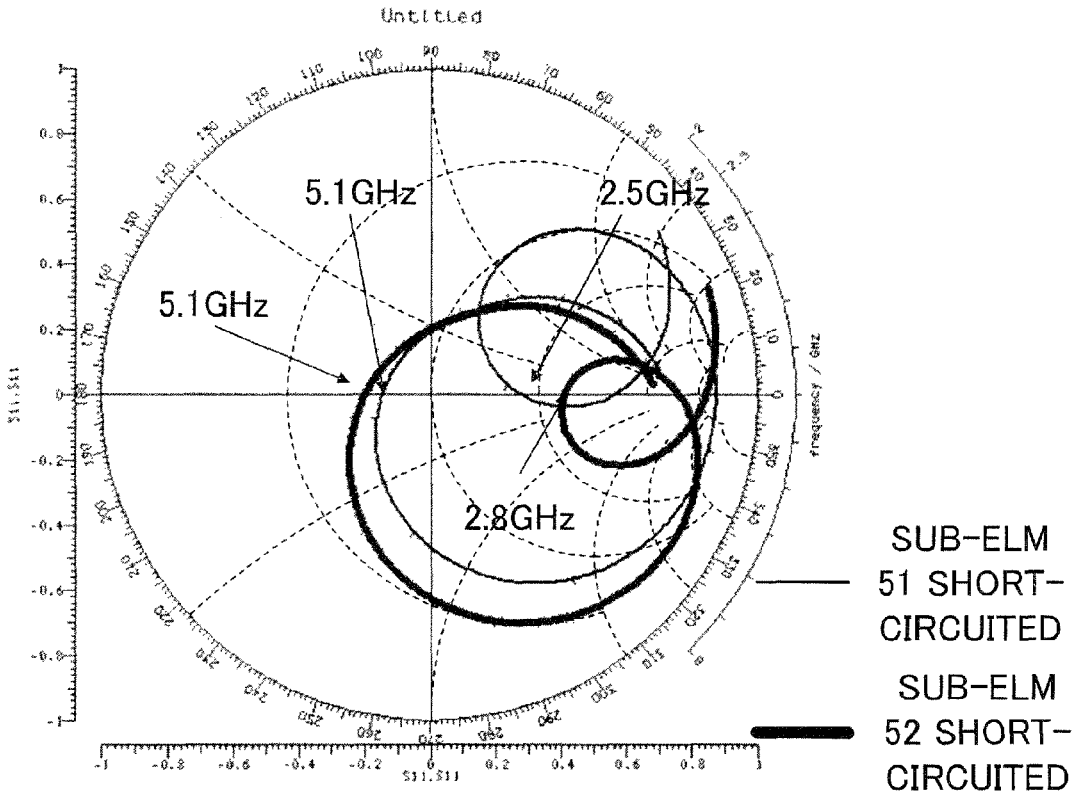
FIG. 20 is a Smith chart showing impedance characteristics in the 2-8 GHz frequency range of the model shown in FIG. 12 and the modification of that model having no short circuit element both in a first sub-element short-circuited case and in a second sub-element short-circuited case.
Figure 21:
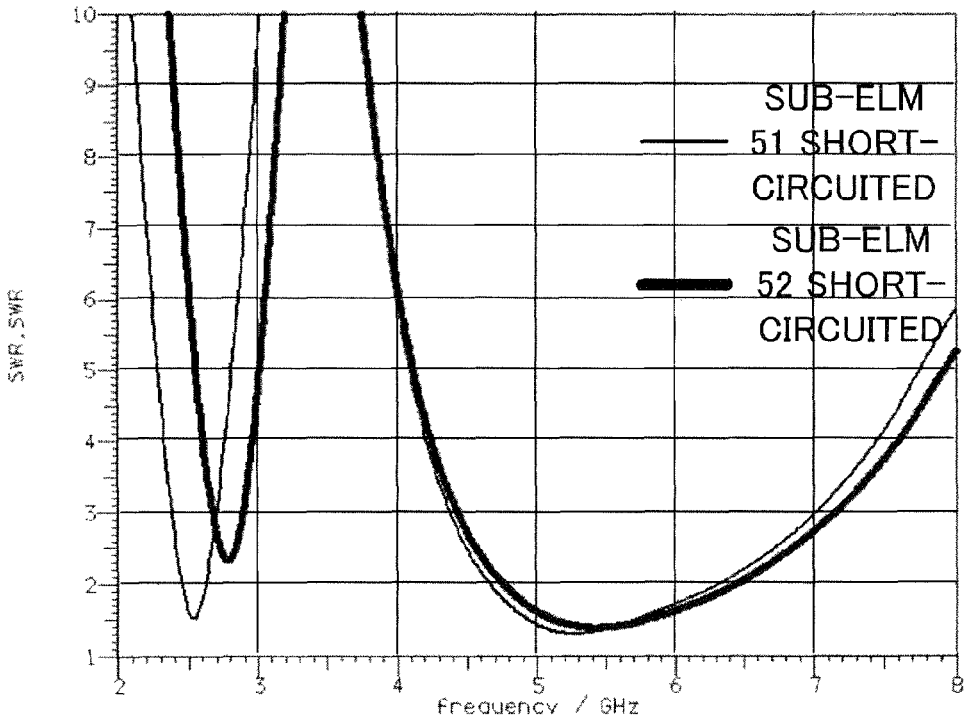
FIG. 21 is a graph showing VSWR characteristics in the 2-8 GHz frequency range observed at the feed portions of the model shown in FIG. 12 and the modification of that model having no short circuit element both in the first sub-element short-circuited case and in the second sub-element short-circuited case.

The resonant frequency and the impedance of the antenna device 5 may be adjusted depending on whether a portion of the first sub-element 51 or of the second sub-element 52 is short-circuited with the ground conductor 3. FIGS. 20-21 are a Smith chart and a graph of frequency characteristics of the radiation efficiency both representing impedance characteristics in a sub-element 51 short-circuited case and in a sub-element 52 short-circuited case, respectively.

If the sub-element 52 is partially short-circuited with the ground conductor 3, a current distribution path related to the resonance in the lower range is formed to be shortest, causing both the resonant frequency and the impedance to be higher than in the sub-element 51 short-circuited case. The resonant frequency and the impedance may be finely adjusted by the choice of which portion is short-circuited as described above.

According to the second embodiment of the present invention described above, a portion that is close to the feed portion of the first sub-element formed as an area, or a portion of the second sub-element may be short-circuited with the ground conductor so that an additional effect may be obtained that the impedance characteristic in the lower range may be adjusted almost separately from the resonant frequency in the higher range.

In the descriptions of the above embodiments, each of the shapes, configurations and locations of the printed boards, ground conductors and antenna elements, or each of the values provided as the conditions of the simulations, has been given as an example and may be variously modified within a scope of the present invention. For instance, the first sub-element may be a polygon other than a quadrilateral or may be like a polygon. The second sub-element may be bent or folded. The sides of the first sub-element and the ground conductor facing each other are not limited to be parallel to each other.

The particular hardware or software implementation of the pre-sent invention may be varied while still remaining within the scope of the present invention. It is therefore to be understood that within the scope of the appended claims and their equivalents, the invention may be practiced otherwise than as specifically described herein.

What is claimed is:

1. An antenna device included in a radio apparatus having a printed board, comprising:

a ground conductor provided in the printed board;

a first sub-element formed as an area having a first side and a second side crossing each other, the first side facing a side of the ground conductor, and the first sub-element having a feed portion at a crossing of the first side and the second side, wherein the first side, the second side, and the ground conductor extend along a same plane;

a second sub-element formed to branch off from the first sub-element around an end of the second side which is farther from the crossing, the second sub-element having an open end, and the second sub-element being directed at least partially in a direction opposite a direction from the crossing to an end of the first side opposite the crossing; and a short circuit element short-circuiting the first sub-element with the ground conductor, wherein the short circuit element branches off from the first sub-element at a point between the feed portion and the end of the second side which is farther from the crossing, and wherein a width of the first sub-element is greater than widths of the second sub-element and the short circuit element, and wherein the area of the first sub-element is greater than areas of the second sub-element and the short circuit element.

2. The antenna device of claim 1, wherein the antenna device has a resonant frequency determined by a path length from the feed portion to the open end of the second sub-element.

3. The antenna device of claim 1, wherein the antenna device has a resonant frequency determined by a path length from the feed portion and along a fringe of the first sub-element, the fringe including the first side.

4. An antenna device included in a radio apparatus having a printed board, comprising: a ground conductor provided in the printed board;

a first sub-element formed as an area having a first side facing a side of the ground conductor and a second side being in a direction crossing the side of the ground conductor, the first side, the second side, and the ground conductor extending along a same plane, and the first sub-element having a feed portion at a first end of the first side which is closer to the second side; a second sub-element formed to branch off from the first sub-element around an end of the second side which is farther from the feed portion, the second sub-element being directed at least partially in a direction opposite a direction from the feed portion to a second end of the first side opposite the first end, and the second sub-element having an open end; and a short circuit element short-circuiting the first sub-element with the ground conductor, wherein the short circuit element branches off from the first sub-element at a point between the feed portion and the end of the second side which is farther from the feed portion, and wherein a width of the first sub-element is greater than widths of the second sub-element and the short circuit element, and wherein the area of the first sub-element is greater than areas of the second sub-element and the short circuit element.

5. The antenna device of claim 4, wherein the antenna device has a resonant frequency determined by a path length from the feed portion to the open end of the second sub-element.

6. The antenna device of claim 4, wherein the antenna device has a resonant frequency determined by a path length from the feed portion and along a fringe of the first sub-element, the fringe including the first side.

7. A radio apparatus, comprising: a printed board having a ground conductor; and an antenna having a first sub-element, a second sub-element and a short-circuit element, wherein the first sub-element is formed as an area having a first side facing a side of the ground conductor and a second side being in a direction crossing the side of the ground conductor, the first side, the second side, and the ground conductor extending along a same plane, and the first sub-element having a feed portion at a first end of the first side which is closer to the second side, wherein the second sub-element is formed to branch off from the first sub-element around an end of the second side which is farther from the feed portion, the second sub-element being directed at least partially in a direction opposite a direction from the feed portion to a second end of the first side opposite the first end, and the second sub-element having an open end, wherein the short circuit element short-circuits the first sub-element with the ground conductor, and wherein the short circuit element branches off from the first sub-element at a point between the feed portion and the end of the second side which is farther from the feed portion, and wherein a width of the first sub-element is greater than widths of the second sub-element and the short circuit element, and wherein the area of the first sub-element is greater than areas of the second sub-element and the short circuit element.

8. The antenna device of claim 7, wherein the antenna device has a resonant frequency determined by a path length from the feed portion to the open end of the second sub-element.

9. The antenna device of claim 7, wherein the antenna device has a resonant frequency determined by a path length from the feed portion and along a fringe of the first sub-element, the fringe including the first side.

* * * * *